US006275135B1

(12) United States Patent
Hibayashi et al.

(10) Patent No.: US 6,275,135 B1
(45) Date of Patent: Aug. 14, 2001

(54) LARGE CURRENT FUSE FOR AUTOMOBILES

(75) Inventors: Yasuko Hibayashi; Norio Matsumura, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/407,306

(22) Filed: Sep. 29, 1999

(30) Foreign Application Priority Data

Oct. 1, 1998 (JP) ..... 10-279514

(51) Int. Cl.[7] ..... H01H 85/143; H01H 85/175; H01R 13/68

(52) U.S. Cl. ..... 337/227; 337/186; 337/231; 337/252; 439/622; 439/893

(58) Field of Search ..... 337/241, 227, 337/186, 228, 231, 246, 248, 252; 29/623; 439/835, 893, 621, 622; 361/104, 807, 809

(56) References Cited

U.S. PATENT DOCUMENTS

| | | | | |
|---|---|---|---|---|
| 3,654,696 | * | 4/1972 | Wechsler et al. | 29/623 |
| 3,818,409 | * | 6/1974 | Pastors et al. | 337/273 |
| 4,511,875 | * | 4/1985 | Arikawa | 337/201 |
| 4,563,666 | * | 1/1986 | Borzoni | 337/252 |
| 4,608,548 | * | 8/1986 | Borzoni | 337/201 |
| 4,670,729 | * | 6/1987 | Oh | 337/264 |
| 4,837,546 | | 6/1989 | Bernstein | 337/272 |
| 5,229,739 | | 7/1993 | Oh et al. | 337/290 |
| 5,293,147 | | 3/1994 | Oh et al. | 337/227 |
| 5,345,211 | * | 9/1994 | Muramatsu et al. | 337/186 |
| 5,416,461 | * | 5/1995 | Totsuka et al. | 337/261 |
| 5,668,521 | * | 9/1997 | Oh | 337/186 |
| 5,745,023 | * | 4/1998 | Totsuka | 337/160 |
| 5,841,337 | * | 11/1998 | Douglass | 337/198 |
| 5,854,583 | * | 12/1998 | Falchetti | 337/290 |
| 6,067,004 | * | 5/2000 | Hibayashi et al. | 337/227 |

FOREIGN PATENT DOCUMENTS

| | | | | |
|---|---|---|---|---|
| 4340979 | * | 7/1994 | (DE) | H01H/85/0445 |
| 9411394 | | 11/1994 | (DE) . | |
| 2637846 | | 4/1997 | (JP) . | |

* cited by examiner

*Primary Examiner*—Leo P. Picard
*Assistant Examiner*—Anatoly Vertman
(74) *Attorney, Agent, or Firm*—Armstrong, Westerman, Hattori, McLeland & Naughton, LLP

(57) ABSTRACT

A large current fuse 1 for automobiles comprising a fuse body 2 consisting of a pair of flat plate portions 4, 4 formed of a sheet metal by pressing process, an arm portion 5 bridging the flat plate portions, and a fuse element 3 attached to the arm portion, wherein a first housing member 10 and a second housing member 30 are arranged around the fuse body at an intermediate portion thereof, the first and second housing members being detachably fitted to each other, whereby the fuse element can be entirely covered with the first and second housing members. At least one of the first housing member and the second housing member is formed of a transparent resin so that the fuse element can be visually observed through the one housing member. A radiation fin is provided on at least one of the first and the second housing members.

10 Claims, 11 Drawing Sheets

LARGE CURRENT FUSE FOR AUTOMOBILES

BACKGROUND OF THE INVENTION

1. Field of the Invention

This invention relates to a large current fuse for automobiles to be installed inside a vehicle.

2. Description of the Related Art A conventional large current fuse 80 for automobiles as shown in FIGS. 21 and 22 has been disclosed (Japanese Patent Registration No. 2637846).

The conventional large current fuse for automobiles consists of a fuse body 81 including a pair of flat plate portions 82, 82 formed of a sheet metal by pressing process, an arm portion 83 provided between the flat plate portions 82 and 82, and a fuse element 84 mounted on the arm portion 83, to which an upper housing 85 and a lower housing 86 are assembled. The upper and lower housings 85 and 86 are so constructed as to sandwich the fuse body 81 therebetween.

However, there has been a drawback with this conventional large current fuse that a visual observation of the fuse element 84 is impossible, because the fuse element 84 is covered with the upper housing 85 and the lower housing 86. In case where the lower housing 86 is formed of a transparent resin or a window 86*a* is formed in it, the lower housing 86 has to be positioned above the fuse element 84. Therefore, it has been inconvenient that assembling direction of the upper housing 85 and the lower housing 86 to the fuse body 81 is restricted.

Moreover, the cost for the assembling work is high because the upper housing 85 and the lower housing 86 are welded to the fuse body 81, which will incur degradation of productivity of the large current fuse 80 for automobiles.

SUMMARY OF THE INVENTION

In view of the above drawbacks, it is an object of the present invention to provide a large current fuse for automobiles in which the fuse element can be visually observed and the assembling direction need not be restricted, and which can be manufactured at a low cost.

In order to attain the above described objects, there is provided according to the present invention, a large current fuse for automobiles comprising a fuse body consisting of a pair of flat plate portions formed of a sheet metal by pressing process, an arm portion bridging the flat plate portions, and a fuse element attached to the arm portion, wherein a first housing member and a second housing member are arranged around the fuse body at an intermediate portion thereof, the first and second housing members being detachably fitted to each other, whereby the fuse element can be entirely covered with the first and second housing members.

According to another feature of the present invention, at least one of the first housing member and the second housing member is formed of a transparent resin, and the fuse element can be visually observed through the one of the housing members.

According to still another feature of the present invention, at least one of the first housing member and the second housing member is provided with a radiation fin.

According to a further feature of the present invention, the first housing member consists of a C-shaped frame body enclosing the fuse element, insertion means respectively formed in a pair of opposing walls of the frame body, and first engaging means provided on a base wall between a pair of the opposing walls, the frame body being introduced in one direction perpendicular to the longitudinal direction of the fuse body.

According to a still further feature of the present invention, the second housing member consists of a C-shaped cover body which is adapted to be inserted into the frame body, and second engaging means provided on the cover body and adapted to engage with the first engaging means, the cover body being introduced in another direction perpendicular to the longitudinal direction of the fuse body.

According to a still further feature of the present invention, positioning cut-outs are formed at four corners of a pair of the flat plate portions at both sides of the arm portion, and third engaging means are provided in the frame body, whereby the first housing member is positioned with respect to the fuse body.

The above and other objects, features and advantages of the present invention will become more apparent from the following detailed description of a preferred embodiment taken in connection with the accompanying drawings.

DESCRIPTION OF THE PREFERRED EMBODIMENTS

Figure 1:
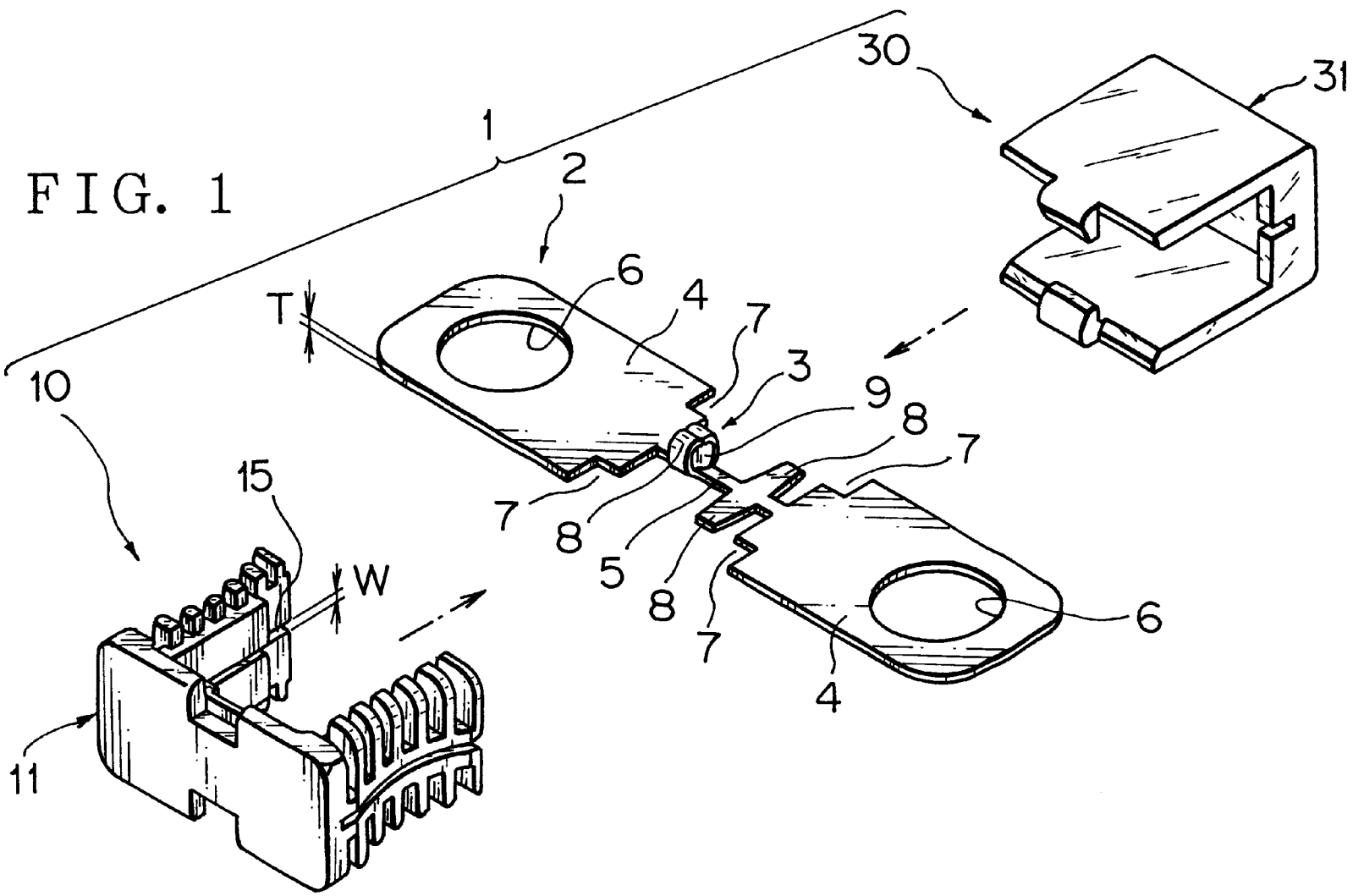
FIG. 1 is an exploded perspective view of a large current fuse for automobiles according to one embodiment of the present invention.

Now, an embodiment of the present invention will be described in detail referring to the drawings.

FIGS. 1 through 20 illustrate one example of a large current fuse for automobiles according to the present invention.

As shown in FIG. 1, a large current fuse 1 for automobiles includes a fuse body 2 having a fuse element 3. The fuse element 3 is adapted to be covered with a first housing member 10 and a second housing member 30 by detachably assembling them to each other.

Figure 2:
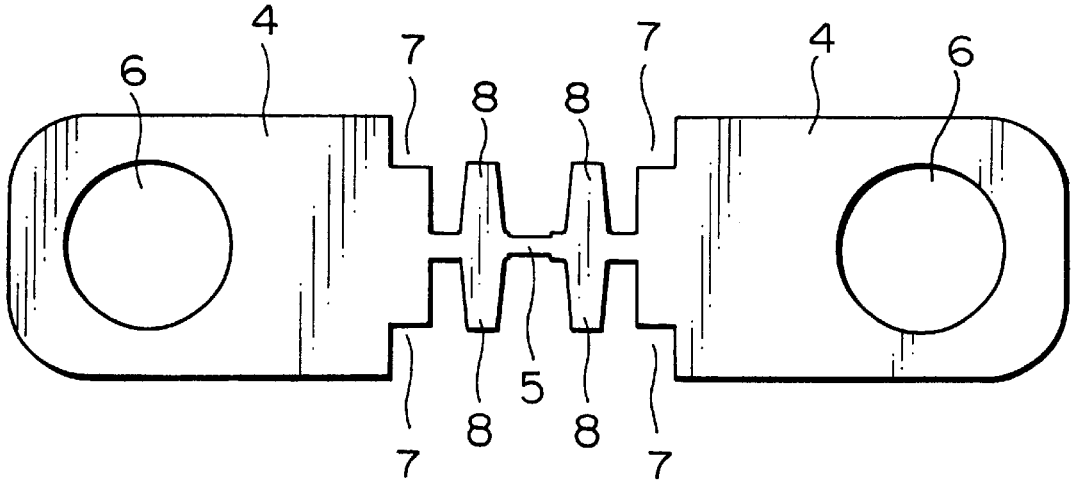
FIG. 2 is a plan view of a sheet metal showing a state before processed into a fuse body.
Figure 3:
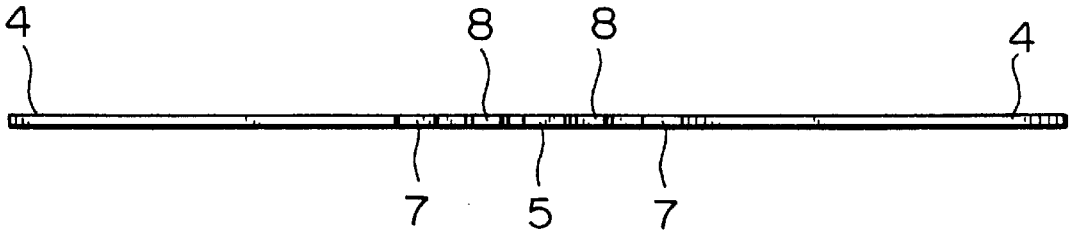
FIG. 3 is a side view of FIG. 2.
Figure 4:
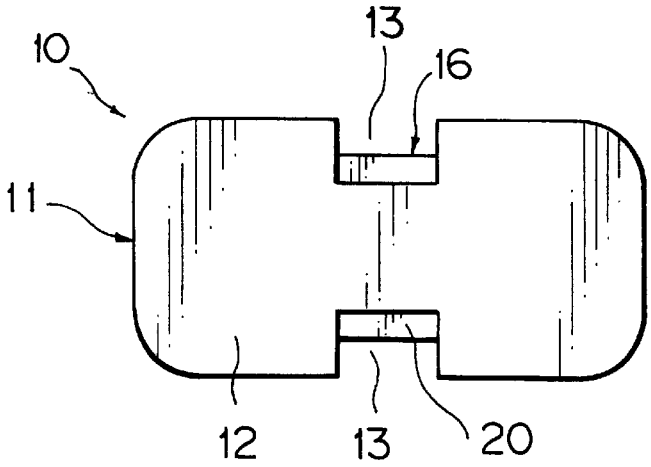
FIG. 4 is a front view of a first housing member shown in FIG. 1.

As shown in FIGS. 2 and 3, the fuse body 2 consists of a pair of flat plate portions 4, 4 formed of a sheet metal (not shown) having a high melting point by pressing process, a linear arm portion 5 brigdingly provided between the flat plate portions 4, 4, and a fuse element 3 mounted on the arm portion 5 as shown in FIG. 1.

As seen in FIGS. 1 to 3, assembling holes 6 for a mating apparatus or a complementary apparatus (not shown) are formed in the flat plate portions 4 at their respective intermediate portions. Cut-outs 7 are formed at four corners of the flat plate portions 4, 4 facing with each other at both sides of the arm portion 5. Into the assembling holes 6, are inserted stud bolts or the like (not shown) of the mating apparatus.

A pair of caulking pieces 8, 8 are provided at longitudinal side edges of the arm portion 5. A tin chip 9 is caulked with the pair of caulking pieces 8, 8 and welded to the arm portion 5. The tin chip 9 has such a characteristic that it is melted off by self-heating when a fusing current flows through the fuse body 2.

In this embodiment, the second housing member 30 is formed of a transparent resin. However, both the first housing member 10 and the second housing member 30 may be formed of a transparent resin.

As shown in FIGS. 4 to 9, the first housing member 10 includes a C-shaped frame body 11 which consists of a base wall 12 having engaging recesses 13 and a pair of opposing walls 14, 14 having respective insertion grooves 15, 15.

The rectangular base wall 12 and a pair of the opposing walls 14, 14 extending in the same direction from opposite ends of the base wall 12 are integrally formed to compose the frame body 11. At an inner face of the frame body 11, is integrally provided a smaller frame body 16 which is smaller than the frame body 11. A pair of the opposing walls 14, 14 have curved outer faces. Preferably, a width W of the insertion groove 15 is substantially the same as a thickness T of the fuse body 2 at the flat plate portion 4 as shown in FIG. 1, so that a posture of the fuse body 2 can be controlled within the insertion groove 15.

Figure 7:
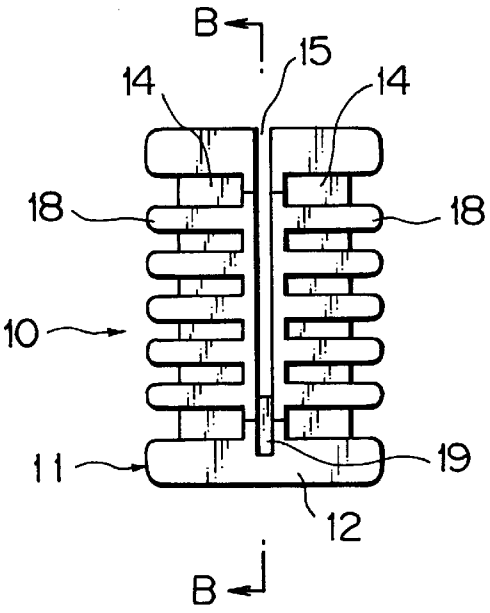
FIG. 7 is a side view of FIG. 4.
Figure 5:
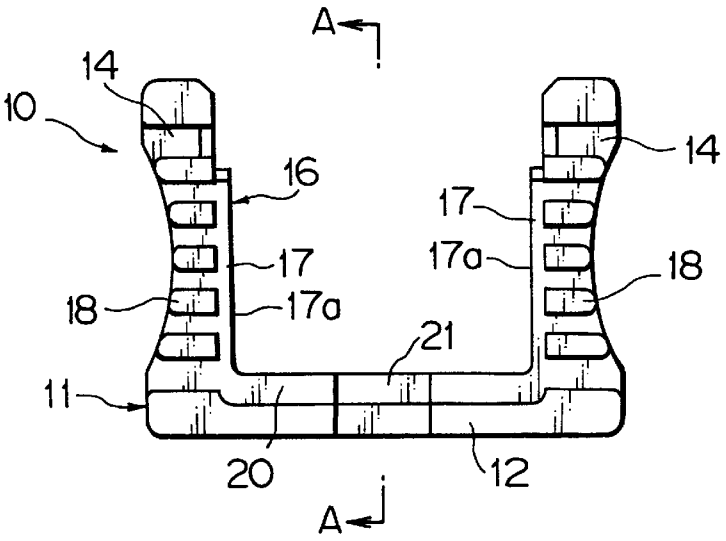
FIG. 5 is a plan view of FIG. 4.
Figure 6:
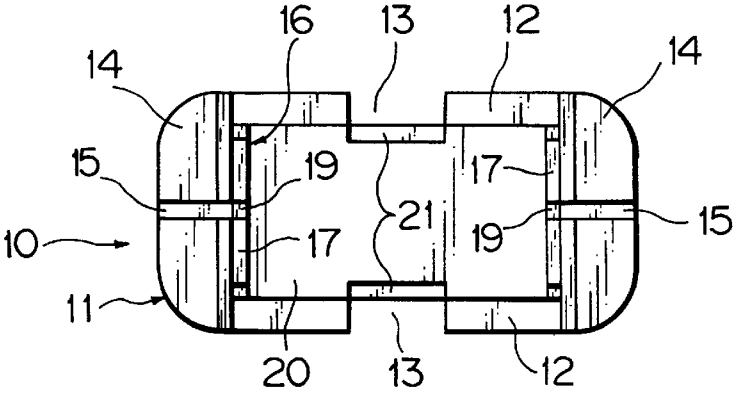
FIG. 6 is a rear view of FIG. 4.
Figure 8:
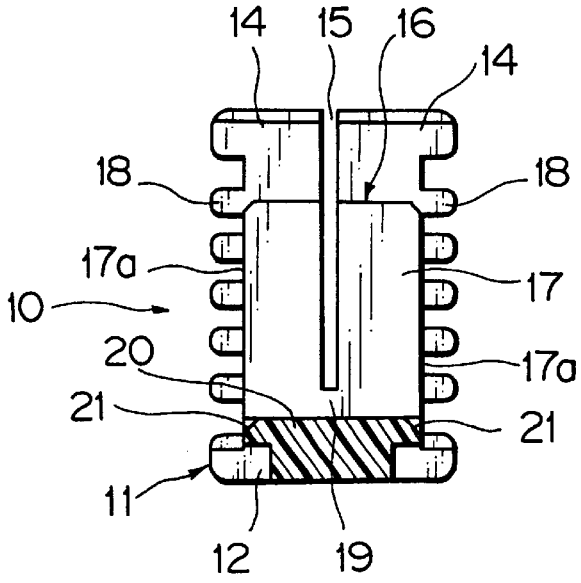
FIG. 8 is a sectional view taken along a line A—A of FIG. 5.
Figure 9:
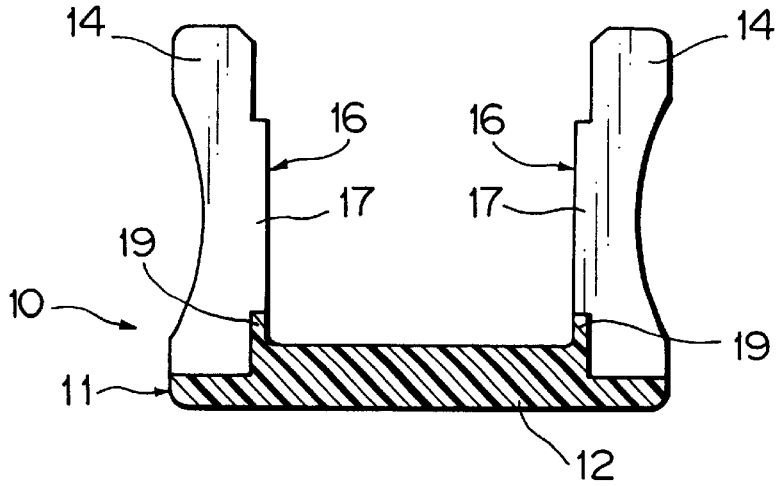
FIG. 9 is a sectional view taken along a line B—B of FIG. 7.
Figure 10:
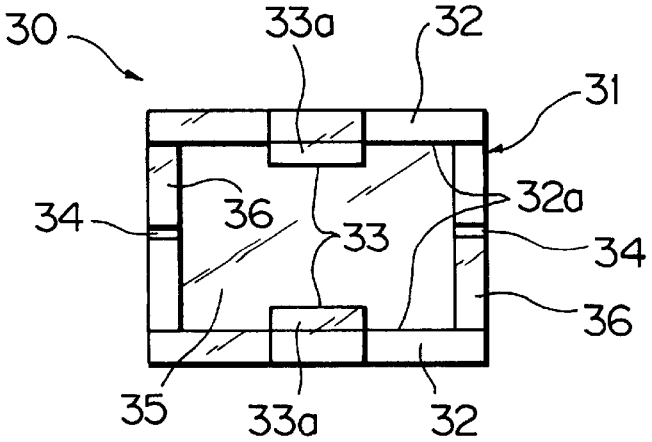
FIG. 10 is a front view of a second housing member shown in FIG. 1.
Figure 11:
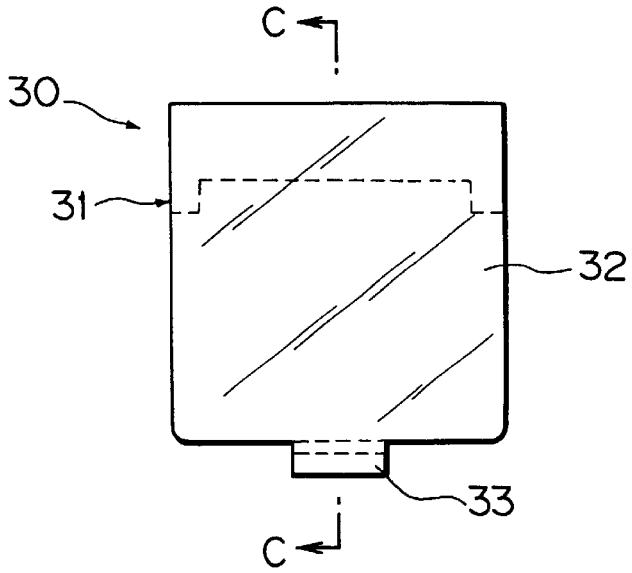
FIG. 11 is a plan view of FIG. 10.

As shown in FIGS. 5 and 7, in both the upper and lower parts of the base wall 12, are formed hollow engaging grooves 13 respectively. Parts of a rectangular wall 20 of the smaller frame body 16 corresponding to the engaging recesses 13 are formed with tapered faces 21, 21. A radiation fin 18 is formed at the outer face of each of the opposing walls 14 in a direction perpendicular to the longitudinal direction. The radiation fin 18 may be arranged in other places than the above described.

As shown in FIGS. 6 to 9, at side walls 17 of the smaller frame body 16, are arranged engaging walls 19 respectively within the insertion grooves 15 at a side of the base wall 12. With an engagement between the positioning cut-outs 7 of the fuse body 2 and the engaging walls 19, the frame body 11 can be positioned with respect to the fuse body 2.

As shown in FIGS. 10 to 13, the second housing member 30 includes a C-shaped cover body 31 adapted to be fitted to the frame body 11, a pair of cover walls 32, 32 having respective engaging projections 33, 33, and engaging grooves 34 formed at the foots of the cover walls 32, 32.

Figure 12:
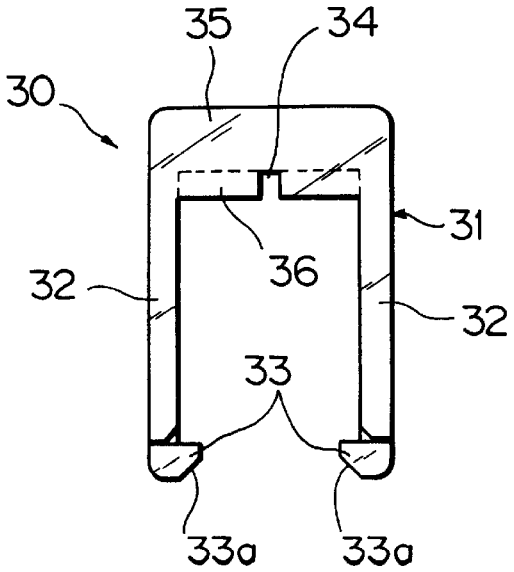
FIG. 12 is a side view of FIG. 10.
Figure 13:
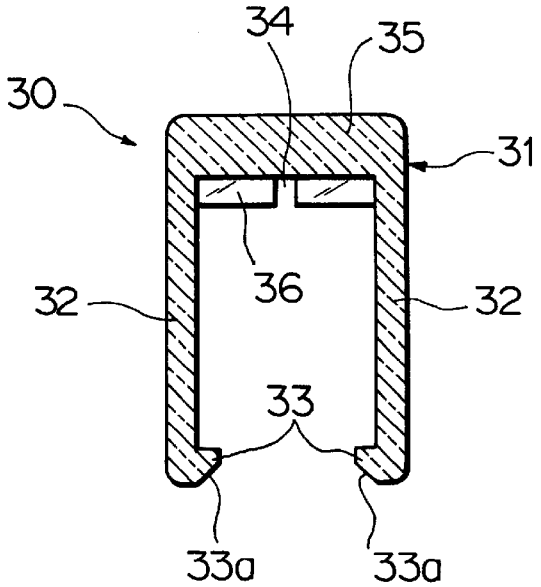
FIG. 13 is a sectional view taken along a line C—C of FIG. 11.

As shown in FIGS. 12 and 13, the cover body 31 includes a rectangular pressure plate 35 and a pair of the cover walls 32, 32 are extending in the same direction from opposite edges of the pressure plate 35. There are formed a pair of side walls 36, 36 between a pair of the cover walls 32, 32 at both sides of the pressure plate 35. The engaging groove 34 is formed in each of the side walls 36. Each of the cover walls 32 has a hook-shaped engaging projection 33 having elasticity. A tapered face 33*a* is formed at a free end of the engaging projection 33.

Figure 16:
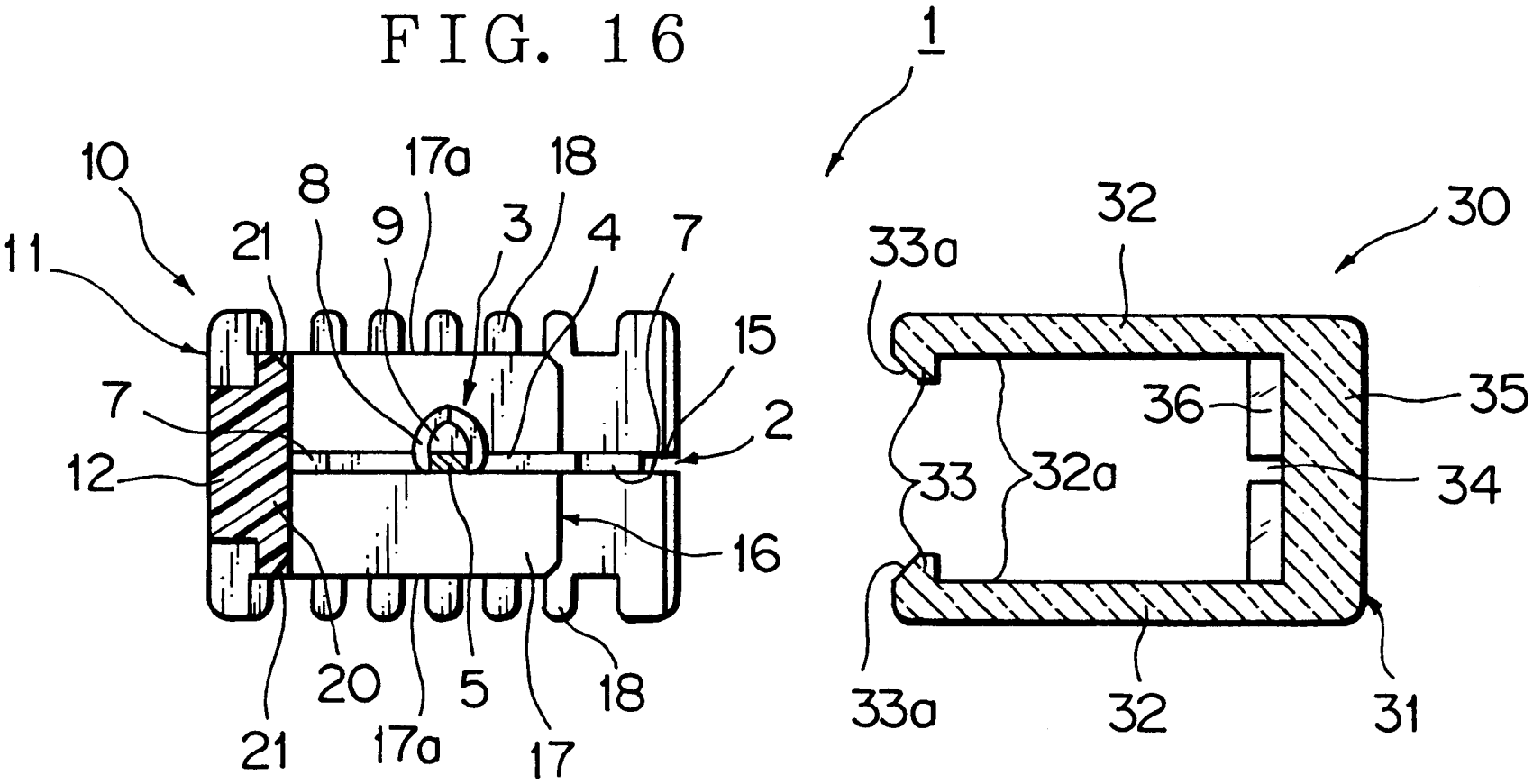
FIG. 16 is a sectional view taken along a line D—D of FIG. 14.
Figure 19:
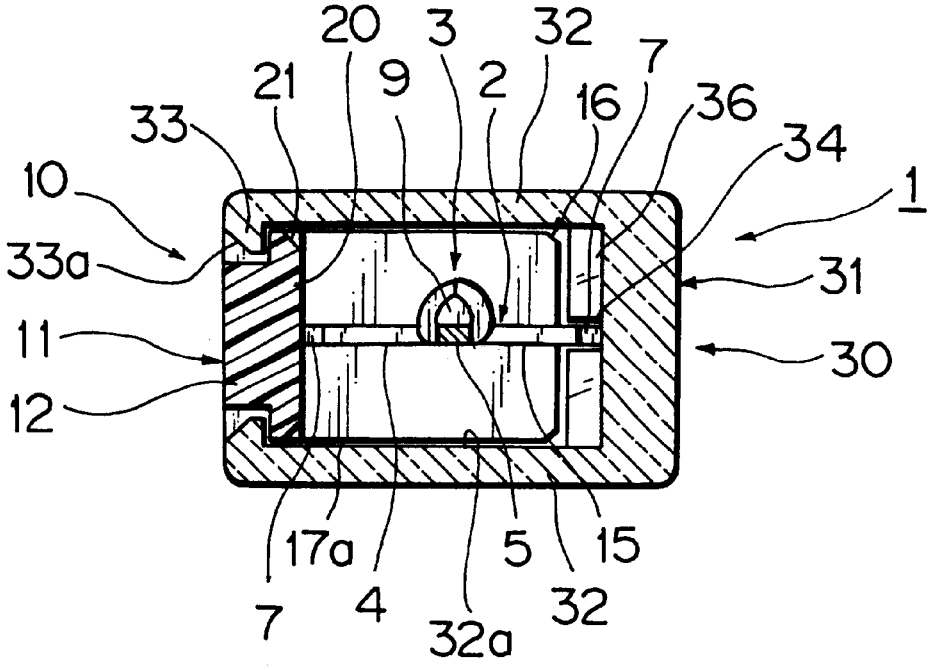
FIG. 19 is a sectional view taken along a line E—E of FIG. 17.
Figure 20:
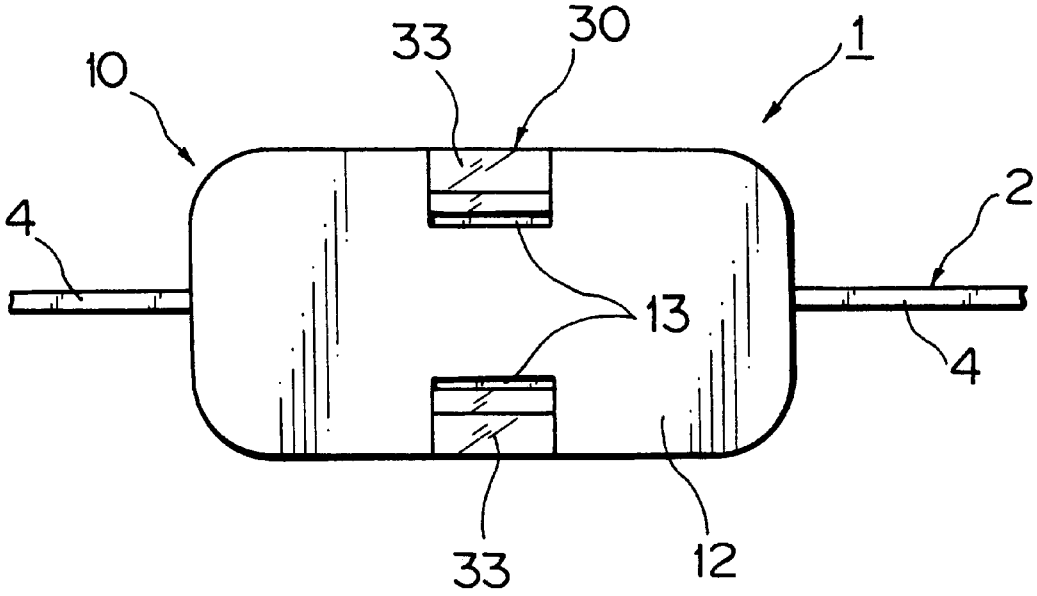
FIG. 20 is a view as seen in a direction of an arrow F in FIG. 17.
Figure 21:
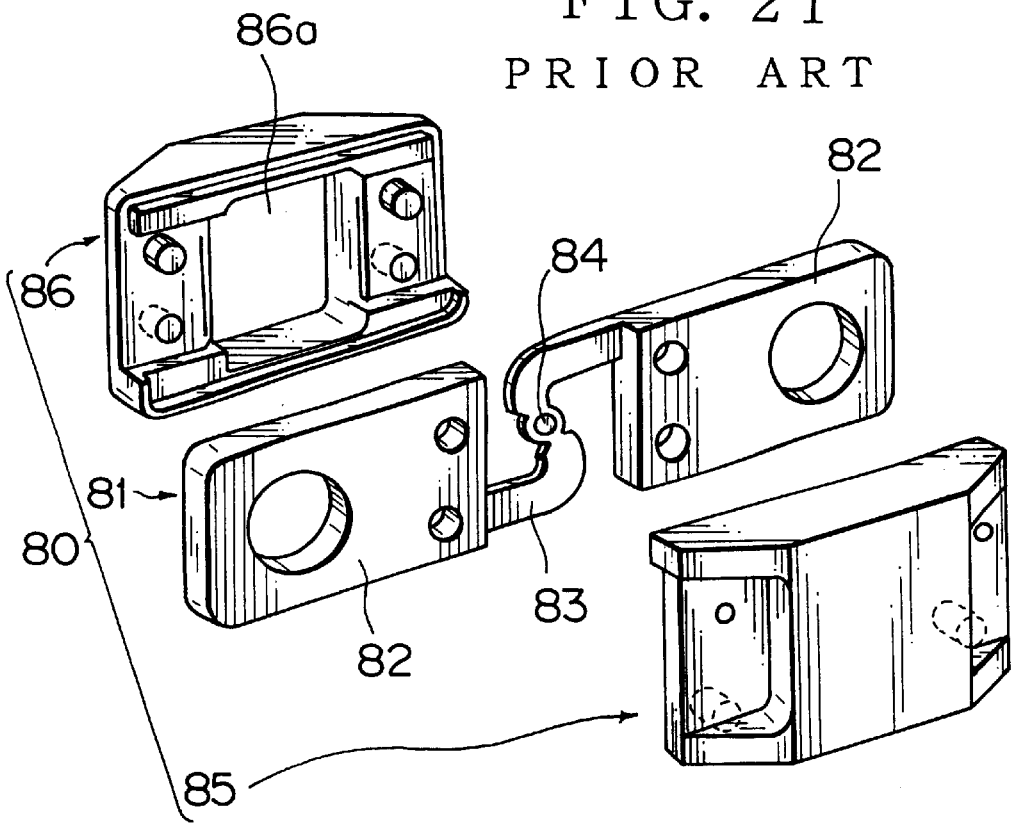
FIG. 21 PRIOR ART
FIG. 21 is an exploded perspective view showing a conventional large current fuse.
Figure 22:
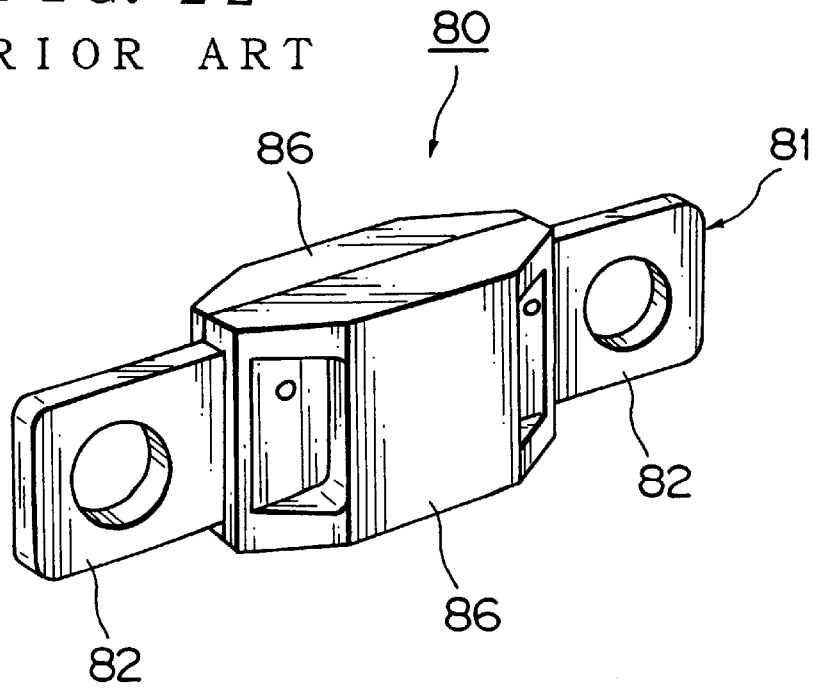
FIG. 22 PRIOR ART
FIG. 22 is a perspective view of the first housing and the second housing assembled to the fuse body in FIG. 21.

As shown in FIG. 16, the cover walls 32 slide along peripheral edges 17*a*, 17*a* of the side walls 17, 17 of the smaller frame body 16, so that the side walls 17, 17 serve as guides for the sliding movement. When the cover body 31 is fitted to the frame body 11 as shown in FIG. 19, the engaging projections 33 come into engagement with the engaging grooves 13. Thus, the first housing member 10 is detachably assembled onto the second housing member 30. After assembled, a pair of the cover walls 32, 32 are positioned above and below the fuse element 3.

Now, a method of mounting the first and second housing members 10, 30 on the fuse body 2 will be explained.

Figure 14:
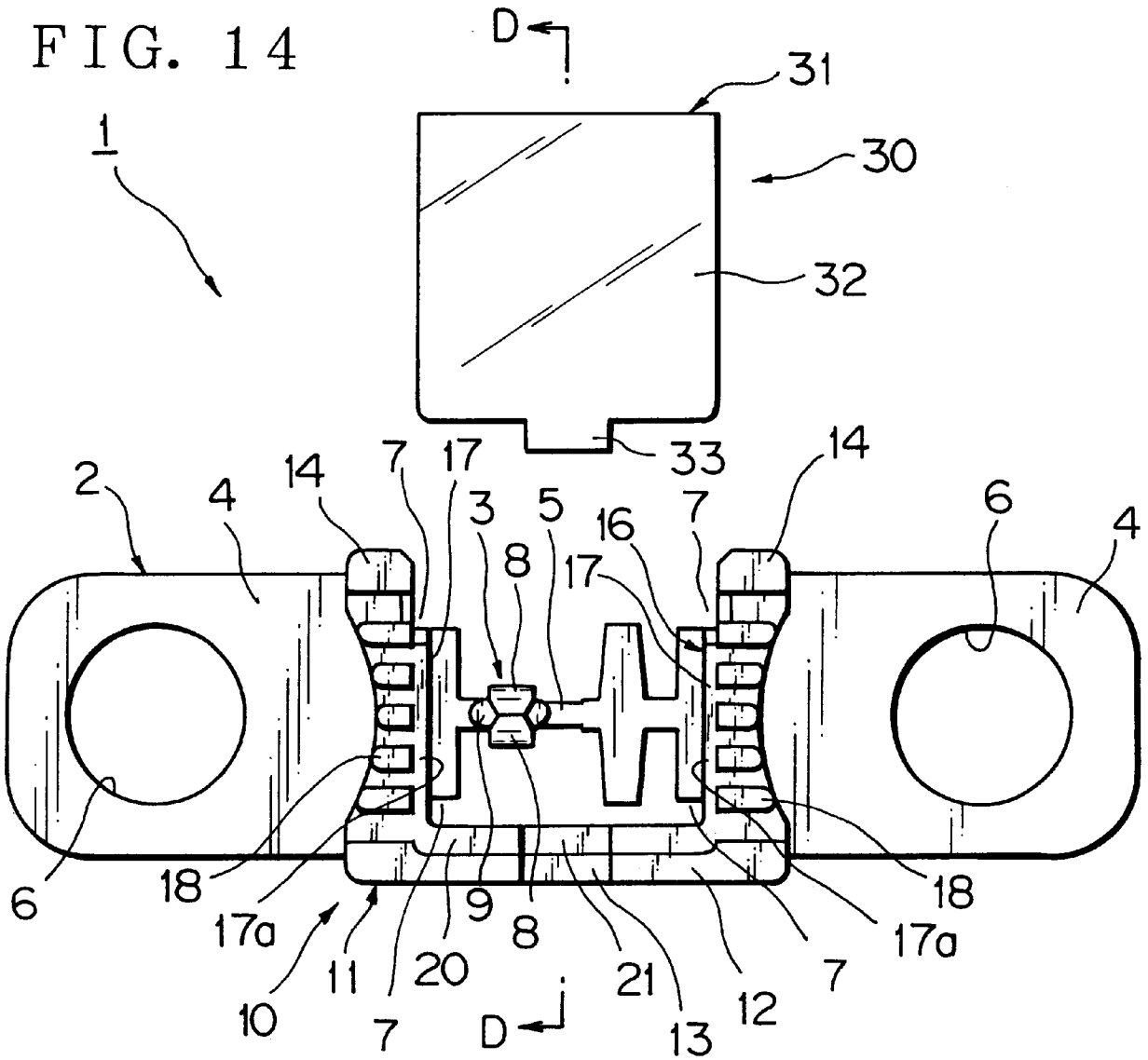
FIG. 14 is a view showing the fuse body and the first housing member in FIG. 1 in an assembled state.
Figure 15:
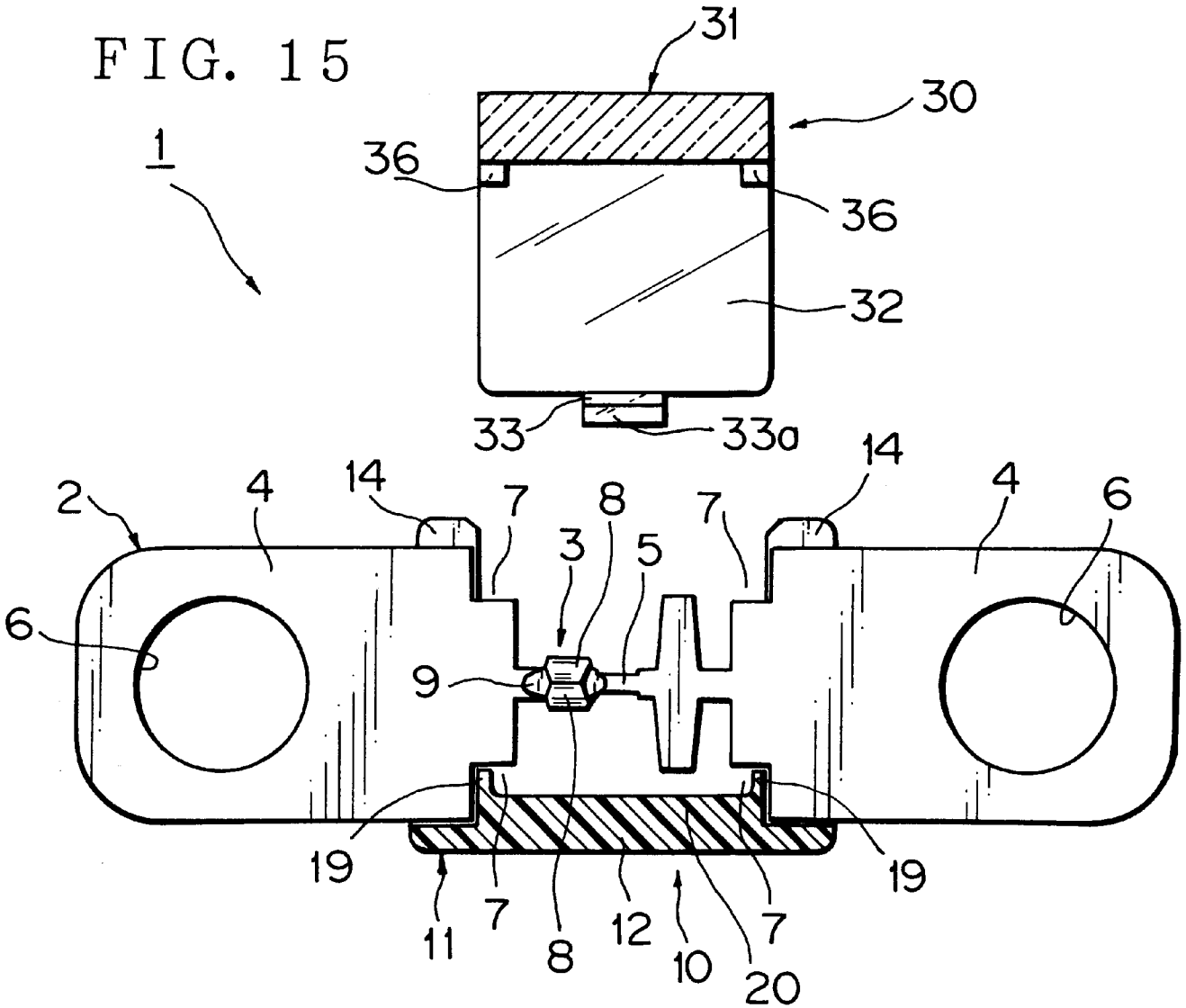
FIG. 15 is a cross-sectional view of the first and second housing members taken in a plane including the fuse body in FIG. 14.

As shown in FIGS. 14 through 16, the first housing member 10 is press fitted to the preformed fuse body 2 in a direction perpendicular to the longitudinal direction of the fuse body 2, so that the flat plate portions 4 and the arm portion 5 are inserted into the insertion grooves 15 of the opposing walls 14. Then, the engaging walls 19 in the insertion grooves 15 are caused to engage with the cut-outs 7 of the flat plate portions 4 respectively.

Figure 17:
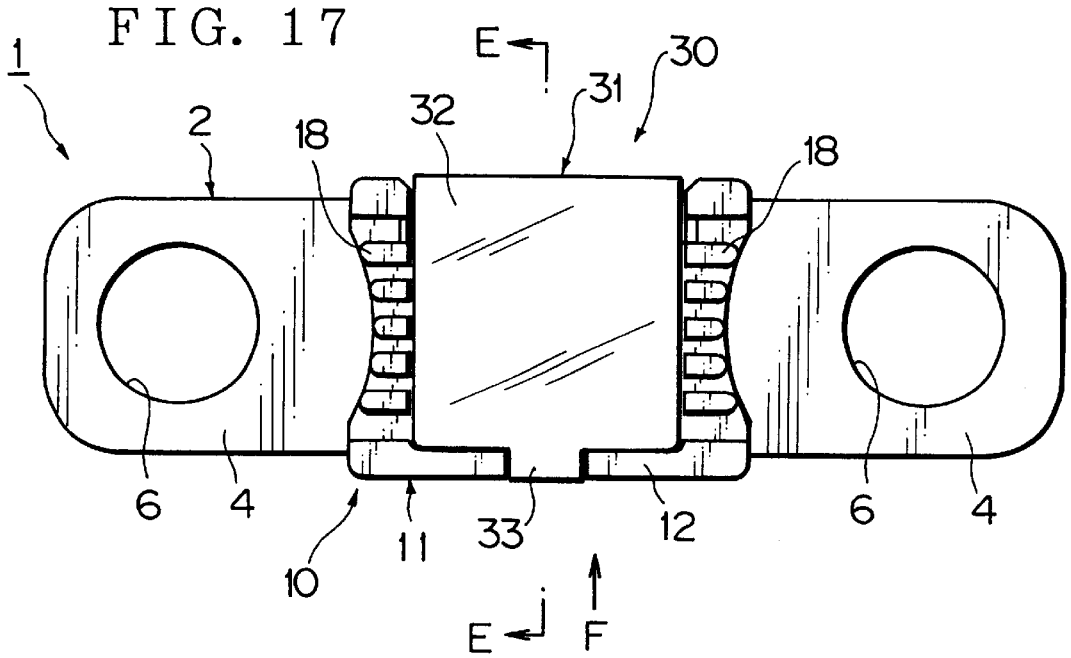
FIG. 17 is a view showing a state in which the second housing member is fitted to the first housing member in FIG. 14.
Figure 18:
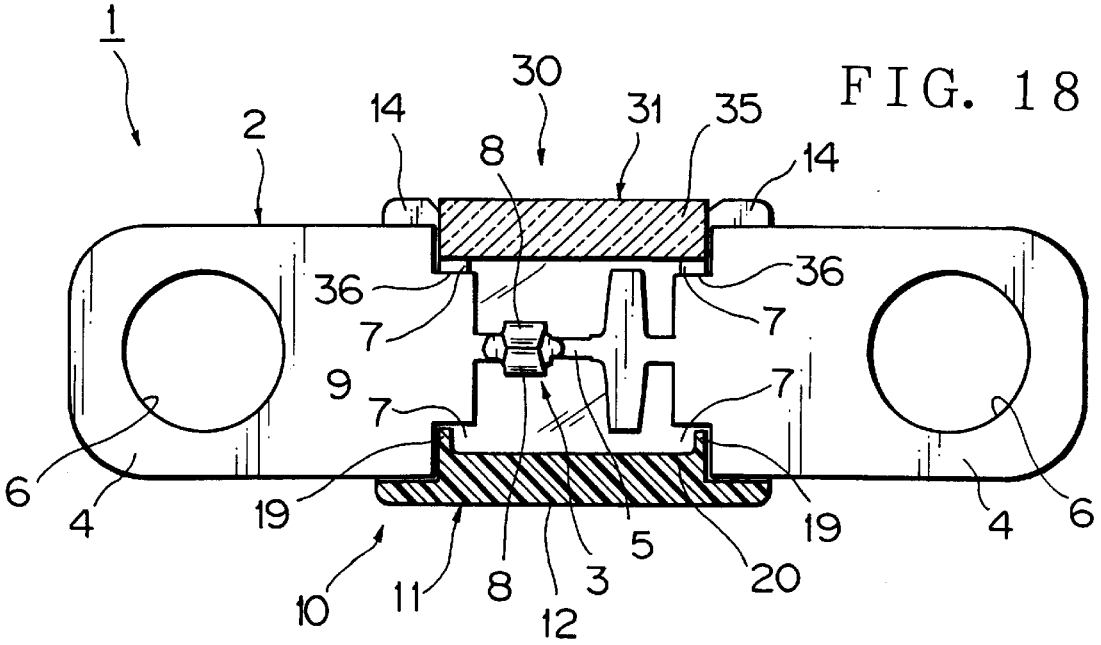
FIG. 18 is a cross-sectional view of the first and second housing members taken in a plane including the fuse body in FIG. 17.

Then, as shown in FIGS. 17 through 19, the second housing member 30 is fitted to the first housing member 10 in a direction perpendicular to the longitudinal direction of the fuse body 2. A pair of the cover walls 32, 32 are caused to slide along the peripheral edges 17*a* of the side walls 17, 17 of the smaller frame body 16 so that the engaging projections 33 go beyond the smaller frame body 16 and engage with the engaging grooves 13 (See FIG. 20). The first housing member 10 and the second housing member 30 are assembled onto the fuse body 2 in this way.

Because a pair of the cover walls 32, 32 are transparent in this embodiment, the fuse element 3 can be visually observed through either one of the cover walls 32, 32. Therefore, the direction wherein the first housing member 10 is fitted to the second housing member 30 can be less restricted as compared with the conventional structure.

Further, because fitting of the first housing member 10 to the second housing member 30 is effected by the engagement between the engaging projections 33 and the engaging grooves 13, the productivity of the large current fuse 1 for automobiles is improved as compared with the conventional welding method, and accordingly the production cost will be reduced. Therefore the large current fuse for automobiles according to the present invention can be manufactured at a lower cost than the conventional one.

Moreover, only one assembling method for the first housing member 10 and the second housing member 30 is described in this embodiment, but it should be noted that there are some other methods applicable.

As described hereinabove, according to the first feature of the present invention, after the first housing member and the second housing member have been arranged around the fuse element of the fuse body, they are detachably fitted to each other, so that the fuse element can be entirely covered with the first and second housing members. Therefore, the first and the second housing members can be fitted around the fuse body with more simple fitting operation than the conventional welding process. The productivity of the large current fuse for automobiles can be thus improved and the production cost will be reduced. In other words, the large current fuse for automobiles can be manufactured at a low cost.

According to the second feature of the present invention, at least one of the first housing member and the second housing member is formed of a transparent resin, and therefore, the fuse element can be visually observed through the one of the housing members. When the large current fuse is mounted on a vehicle, the positioning restriction in a vertical direction can be abolished different from the prior art wherein such vertical positioning has been restricted in order to visually observe the fuse element.

According to the third feature of the present invention, at least one of the first housing member and the second housing member is provided with the radiation fin, through which the heat generated around the fuse element is reliably dissipated. With this structure, a rise of the temperature in the interior enclosed with the first housing member and the second housing member can be decreased.

According to the fourth feature of the present invention, the first housing member consists of the C-shaped frame body enclosing the fuse element, the insertion means respectively formed in a pair of the opposing walls of- the frame body, and the first engaging means provided on the base wall between a pair of the opposing walls. The frame body is introduced in one direction perpendicular to the longitudinal direction of the fuse body. The first housing member can be thus fitted to the fuse body by simply inserting the fuse body into the insertion means.

According to the fifth feature of the present invention, the second housing member consists of the C-shaped cover body which is adapted to be fitted to the frame body, and the second engaging means provided on the cover body and adapted to engage with the first engaging means. The cover body is introduced in the other direction perpendicular to the longitudinal direction of the fuse body which is opposite to the inserting direction of the frame body. In this way, the cover body can be simply arranged on the fuse body.

According to the sixth feature of the present invention, the positioning cut-outs are formed at the four corners of a pair of the flat plate portions at both sides of the arm portion, and the third engaging means are provided in the frame body, whereby the first housing member is surely positioned with respect to the fuse body. In this way, the first housing member can be thus maintained at a fixed position, and the manufacturing process can be rapidly performed.

What is claimed is:

1. A large current fuse for automobiles comprising a fuse body consisting of a pair of flat plate portions formed of a sheet metal by pressing process, an arm portion bridging said flat plate portions, and a fuse element attached to said arm portion, wherein a first housing member and a second housing member are arranged around said fuse body at an intermediate portion thereof, said first and second housing members being detachably fitted to each other, whereby said fuse element can be entirely covered with said first and second housing members, and said first housing member consists of a C-shaped frame body enclosing said fuse element, insertion grooves for said fuse body respectively formed in a pair of opposing walls of said frame body, said grooves accepting said fuse body upon insertion, and first engaging means provided on a base wall between a pair of said opposing walls, said frame body being introduced in one direction perpendicular to the longitudinal direction of said fuse body.

2. A large current fuse for automobiles as claimed in claim 1, wherein at least one of said first housing member and said second housing member is formed of a transparent resin, whereby said fuse element can be visually observed through said one of the housing members.

3. A large current fuse for automobiles as claimed in claim 1 or 2, wherein at least one of said first housing member and said second housing member is provided with a radiation fin.

4. A large current fuse for automobiles as claimed in claim 1, wherein said second housing member consists of a C-shaped cover body which is adapted to be fitted to said frame body, and second engaging means provided on said cover body and adapted to engage with said first engaging means, said cover body being introduced in another direction perpendicular to the longitudinal direction of said fuse body.

5. A large current fuse for automobiles as claimed in claim 1, wherein positioning cut-outs are formed at four corners of a pair of said flat plate portions at both sides of said arm portion, and third engaging means for engaging with said positioning cut-outs are provided in said frame body.

6. A large current fuse for automobiles comprising a fuse body consisting of a pair of flat plate portions formed of a sheet metal by pressing process, an arm portion bridging said flat plate portions, and a fuse element attached to said arm portion, wherein a first housing member and a second housing member are arranged around said fuse body at an intermediate portion thereof, said first and second housing members being detachably fitted to each other, whereby said fuse element can be entirely covered with said first and second housing members, and said first housing member consists of a C-shaped frame body enclosing said fuse element, insertion means for said fuse body respectively formed in a pair of opposing walls of said frame body, said insertion means accepting said fuse body upon insertion, of said fuse body in said insertion means, and first engaging means provided on a base wall between a pair of said opposing walls, said frame body being introduced in one direction perpendicular to the longitudinal direction of said fuse body.

7. A large current fuse for automobiles as claimed in claim 6, wherein at least one of said first housing member and said second housing member is formed of a transparent resin, whereby said fuse element can be visually observed through said one of the housing members.

8. A large current fuse for automobiles as claimed in claim 6 or 7, wherein at least one of said first housing member and said second housing member is provided with a radiation fin.

9. A large current fuse for automobiles as claimed in claim 6, wherein said second housing member consists of a C-shaped cover body which is adapted to be fitted to said frame body, and second engaging means provided on said cover body and adapted to engage with said first engaging means, said cover body being introduced in another direction perpendicular to the longitudinal direction of said fuse body.

10. A large current fuse for automobiles as claimed in claim 6, wherein positioning cut-outs are formed at four corners of a pair of said flat plate portions at both sides of said arm portion, and third engaging means for engaging with said positioning cut-outs are provided in said frame body.

* * * * *